US006926574B2

(12) United States Patent
Fujiwara

(10) Patent No.: US 6,926,574 B2
(45) Date of Patent: Aug. 9, 2005

(54) PLASMA DISPLAY PANEL THAT IS OPERABLE TO SUPPRESS THE REFLECTION OF EXTRANEOUS LIGHT, THEREBY IMPROVING THE DISPLAY CONTRAST

(75) Inventor: Shinya Fujiwara, Kyoto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 83 days.

(21) Appl. No.: 10/704,973

(22) Filed: Nov. 12, 2003

(65) Prior Publication Data

US 2004/0097162 A1 May 20, 2004

Related U.S. Application Data

(62) Division of application No. 10/401,761, filed on Mar. 31, 2003, now Pat. No. 6,864,630, which is a continuation of application No. 09/274,339, filed on Mar. 23, 1999, now abandoned.

(30) Foreign Application Priority Data

Mar. 24, 1998 (JP) ..... 10-075250

(51) Int. Cl.[7] ..... H01J 9/00; H01J 9/02

(52) U.S. Cl. ..... 445/24; 445/25; 430/322; 430/330; 430/396

(58) Field of Search ..... 445/24, 25; 313/582–587; 430/322, 330, 396

(56) References Cited

U.S. PATENT DOCUMENTS

| | | | | |
|---|---|---|---|---|
| 3,943,007 A | | 3/1976 | Lebrun | 429/87 |
| 4,320,418 A | | 3/1982 | Pavliscak | 348/797 |
| 4,803,402 A | | 2/1989 | Raber et al. | 313/509 |
| 4,853,590 A | | 8/1989 | Andreadakis | 313/485 |
| 5,428,263 A | | 6/1995 | Nagano | 313/585 |
| 5,541,479 A | | 7/1996 | Nagakubo | 313/586 |
| 5,661,500 A | | 8/1997 | Shinoda et al. | 345/60 |
| 5,818,168 A | | 10/1998 | Ushifusa et al. | 313/582 |
| 5,851,732 A | | 12/1998 | Kanda et al. | 430/321 |
| 5,900,694 A | | 5/1999 | Matsuzaki et al. | 313/484 |
| 5,977,708 A | | 11/1999 | Amatsu et al. | 313/586 |
| 6,156,433 A | | 12/2000 | Hatori et al. | 428/411.1 |
| 6,276,980 B1 | * | 8/2001 | Kim | 445/24 |

FOREIGN PATENT DOCUMENTS

| | | |
|---|---|---|
| EP | 0 863 534 | 9/1998 |
| JP | 6-1176035 | 8/1986 |
| JP | 1239532 | 9/1989 |
| JP | 4-272634 | 9/1992 |
| JP | 5-41166 | 2/1993 |
| JP | 8-227664 | 9/1996 |
| JP | 9-134675 | 5/1997 |
| JP | 10-40821 | 2/1998 |

* cited by examiner

*Primary Examiner*—Mariceli Santiago
(74) *Attorney, Agent, or Firm*—Wenderoth, Lind & Ponack, L.L.P.

(57) ABSTRACT

A plasma display device having a front substrate and a rear substrate is provided. The front substrate is constituted from a transparent first insulating substrate, and a plurality of stripe-shaped first electrodes including at least one discharge electrode and extending parallel to each other. The rear substrate is constituted from a second insulating substrate, a plurality of second electrodes extending parallel to each other, and a plurality of ribs forming a plurality of discharge spaces therebetween. The discharge electrode includes a transparent electrode, a black-colored first conductive layer, and a second conductive layer. The second conductive layer has a lower resistivity than the first conductive layer and is made with widths smaller than those of the first conductive layer and extends to the edge of the first insulating substrate.

2 Claims, 8 Drawing Sheets

PLASMA DISPLAY PANEL THAT IS OPERABLE TO SUPPRESS THE REFLECTION OF EXTRANEOUS LIGHT, THEREBY IMPROVING THE DISPLAY CONTRAST

This application is a divisional of Ser. No. 10/401,761, filed Mar. 31, 2003, now U.S. Pat. No. 6,864,630, which is a continuation of Ser. No. 09/274,339, filed Mar. 23, 1999, now abandoned.

BACKGROUND OF THE INVENTION

1. Field of the Invention

The present invention relates to a plasma display panel used for displaying images of television, computer and other apparatuses.

2. Description of Related Art

An example of a plasma display panel of the prior art will be described below with reference to FIG. 7 which is a partially cutaway perspective view of an AC type plasma display panel.

The plasma display panel is configured such that a front substrate includes a transparent first insulating substrate 51, a plurality of pairs of stripe-shaped scanning electrodes 52 and sustaining electrodes 53, a dielectric layer 54, and a protection layer 55 formed in this order. A rear substrate includes a second insulating substrate 56, a plurality of stripe-shaped data electrodes 57 extending perpendicular to the scanning electrodes 52 and the sustaining electrodes 53, and strip-shaped ribs 59 formed on the second insulating substrate 56 forming a plurality of discharge spaces therebetween. The front and rear substrate are formed one upon another. The scanning electrodes 52 and the sustaining electrodes 53 include stripe-shaped transparent electrodes 52*a*, 53*a* that are electrically conductive, and conductive layers 52*b*, 53*b*, respectively. The conductive layer formed on the transparent electrode is in the shape of a stripe having a smaller width than the transparent electrode, and contains silver. Metals such as copper and chromium can be employed instead of silver in the conductive layer, as is disclosed in U.S. Pat. No. 3,943,007.

A discharge space 58 is filled with a discharge gas including at least one kind of rare gas chosen from helium, neon, argon, krypton and xenon. When the panel is used for color display, a phosphor 60 (only a part of which is shown) is formed to extend over the data electrodes 57 to the side face of the ribs 59.

Now the operation of the AC type plasma display panel of the prior art will be described below.

In a sustaining period of a drive operation, a pulse voltage is applied alternately between the scanning electrodes 52 and the sustaining electrodes 53 so that a sustaining discharge is generated in the discharge space 58 by an electric field generated between the surface of the protection layer 55 on the dielectric layer 54 over the scanning electrodes 52 and the surface of the protection layer 55 on the dielectric layer 54 over the sustaining electrodes 53, to thereby produce an image with visible light generated by the sustaining discharge. To provide a color display, the phosphor 60 is excited by ultraviolet rays emitted by the sustaining discharge and an image is produced by using visible light emitted by the phosphor 60.

On the other hand, in an addressing period of a drive operation, a pulse voltage is applied between the data electrodes 57 and the scanning electrodes 52 or the sustaining electrodes 53 in order to generate an addressing discharge.

In any case, the panel is configured to allow the image to be viewed from the front substrate side of the panel.

A method for forming the scanning electrodes 52, the sustaining electrodes 53, the dielectric layer 54 and the protection layer 55 on the first insulating substrate 51 will be described below taking reference to FIG. 8 which shows a cross sectional view along a projected line in FIG. 7.

In FIG. 8, stripe-shaped transparent electrodes 52*a*, 53*a* made of an electrically conductive material such as tin oxide ($SnO_2$) or indium tin oxide (ITO) are formed on the transparent first insulating substrate 51 which, with silver paste printed thereon, is dried and fired to thereby make stripe-shaped conductive layers 52*b*, 53*b* that include silver. The entire surface of this substrate is coated with glass paste which is dried and fired to thereby make the vitrified dielectric layer 54, which is further covered by the protection layer 55 formed by vapor deposition of manganese oxide (go).

However, the conductive layers 52*b*, 53*b* of this panel have high reflectivity of the surface because the conductive layers 52*b*, 53*b* contain silver which is added to improve conductivity. Consequently, extraneous light is reflected on the surface of the conductive layers 52*b*, 53*b* as indicated by a solid line in FIG. 8, resulting in a problem of significantly low contrast of the display.

SUMMARY OF THE INVENTION

To solve the problems described above, the present invention provides a plasma display panel including front and rear substrates formed one upon another. The front substrate includes a transparent first insulating substrate, a plurality of stripe-shaped first electrodes extending parallel to each other, each electrode including at least one stripe-shaped discharge electrode, the discharge electrode including a transparent electrode, a black-colored first conductive layer and a second conductive layer formed in this order. The second conductive layer has a lower resistivity than the first conductive layer. The rear substrate includes a second insulating substrate, a plurality of second electrodes formed on the second insulating substrate so as to extend parallel to each other, and a plurality of ribs formed on the second insulating substrate so as to separate neighboring second electrodes, forming a plurality of discharge spaces therebetween, and the plurality of first electrodes extending generally perpendicular to the plurality of second electrodes.

This configuration makes it possible to suppress the reflection of extraneous light because the black-colored first conductive layer is formed on the transparent first insulating substrate, thereby improving the display contrast and the panel characteristics. Deterioration in the conductivity due to the black color of the first conductive layer can be compensated for by the second conductive layer which has a low resistivity.

The first conductive layer is made of a material selected from ruthenium oxide and a compound oxide of ruthenium.

With this configuration, a black conductive film which does not reflect light can be formed and, even when float glass of lower production cost is used for the transparent first insulating substrate, there occurs no yellowish discoloration due to reaction of light transmitted through the transparent electrode and the float glass, thus enabling almost complete blackening.

The second conductive layer contains silver. This makes it possible to form a conductive film of lower resistivity which, when a voltage is applied, causes lower voltage drop and lower time constant.

The second conductive layer has a width not greater than that of the first conductive layer. This eliminates the possibility of the second conductive layer to be beyond the edge of the first conductive layer even when the first conductive layer and the second conductive layer are misaligned when formed. Consequently, reflection of light by the second conductive layer can be completely eliminated even when misalignment occurs.

The second conductive layer extends to a terminal portion of the first insulating substrate to be connected with an external electrode. Thus, because only an effective display area can be blackened and the bonding strength with the float glass which makes the transparent fast insulating substrate can be increased, connection with external circuits can be made more stable and reliable.

Also, the second conductive layer includes a plurality of layers. This configuration makes it possible to form a conductive film of lower resistivity, and to form a film which shuts off the transfer of silver below the conductive layer that contains silver.

BRIEF DESCRIPTION OF THE DRAWINGS

The above and other objects and features of the present invention will become more apparent from the following description of preferred embodiments thereof with reference to the accompanying drawings, throughout which like parts are designated by like reference numerals.

DESCRIPTION OF THE PREFERRED EMBODIMENTS

This application is based on application No. 10-075250 filed 1998. Mar. 24 in Japan, the content of which is incorporated hereinto by reference.

Embodiment 1

Figure 1:
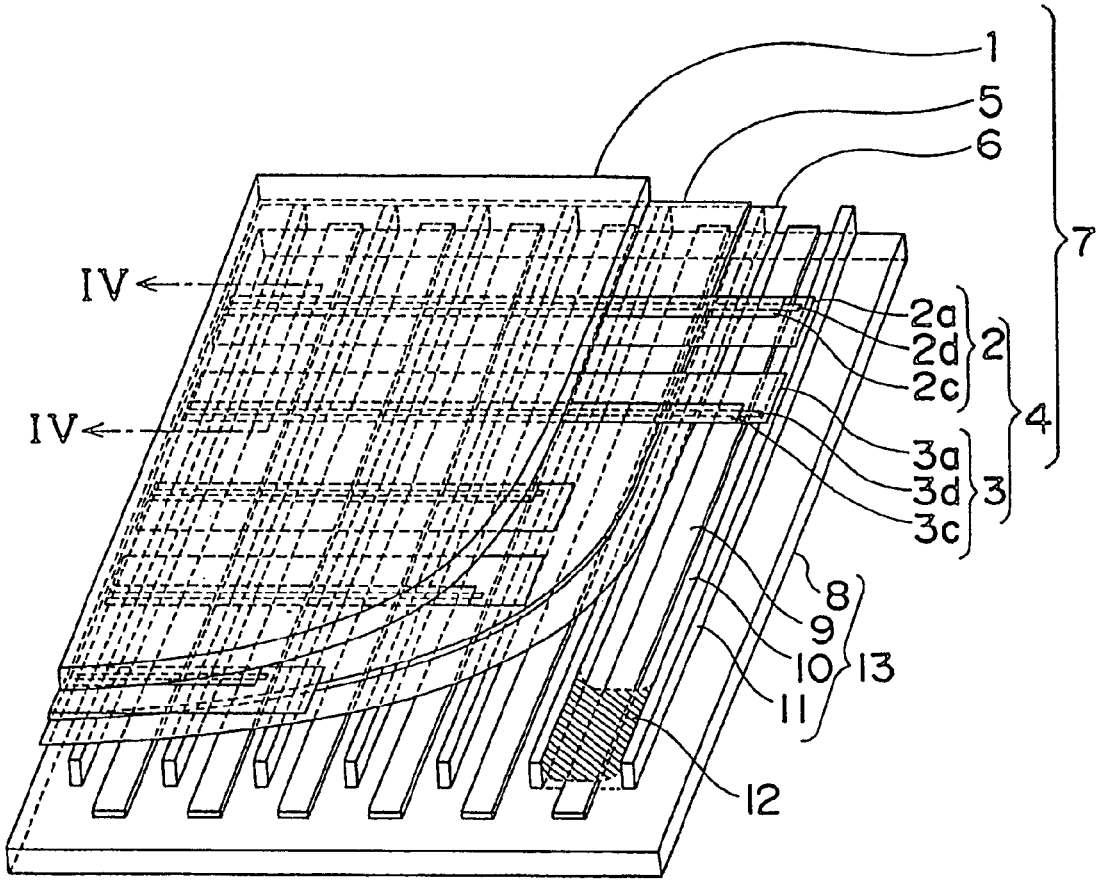
FIG. 1 is a partially cutaway perspective view of the AC type plasma display panel according to the first embodiment of the present invention.

FIG. 1 is a partially cutaway perspective view of an AC type plasma display panel according to the first embodiment of the present invention.

The plasma display panel has a configuration such that a front substrate 7 and rear substrates 13, are formed one upon another. The front substrate 7 includes a transparent first insulating substrate 1, a plurality of stripe-shaped first electrodes 4 extending parallel to each other, a dielectric layer 5, and a protection layer 6 formed in this order. The rear substrate 13 includes a second insulating substrate 8, a plurality of second electrodes 9 (called data electrodes in this embodiment) formed on the second insulating substrate 8 so as to extend parallel to each other, and a plurality of ribs 11 formed on the second insulating substrate 8 so as to separate neighboring (adjacent) second electrodes 9, forming a plurality of discharge spaces 10 therebetween. The plurality of first electrodes 4 extend generally perpendicular to the plurality of second electrodes 9. The first electrode 4 includes two discharge electrodes, which are a scanning electrode 2 and a sustaining electrode 3. The scanning second electrode 2 and the sustaining electrode 3 include stripe-shaped transparent electrodes 2*a*, 3*a*, stripe-shaped black-colored first conductive layers 2*c*, 3*c* having widths smaller than those of the transparent electrodes, 2*a*, 3*a* and second conductive layers 2*d*, 3*d* formed in this order, respectively, the second conductive layer have lower resistivity than the first conductive layer.

The second conductive layers 2*d*, 3*d* are formed with widths smaller than those of the first conductive layers 2*c*, 3*c* and extend to the edge of the transparent first insulating substrate 1. The black-colored first conductive layers 2*c*, 3*c* are formed from ruthenium oxide or a compound oxide of ruthenium, while the second conductive layers 2*d*, 3*d* are formed from conductive film containing silver. The discharge space 10 is filled with a discharge gas including at least one kind of rare gas chosen from helium, neon, argon, krypton and xenon. When the panel is used for color display, a phosphor 12 (only a part of which is shown) is formed to extend over the data electrodes 9 to the side face of the ribs 11.

Now the operation of the AC type plasma display panel will be described below.

In a sustaining period of a drive operation, pulse voltage is applied alternately between the scanning electrode 2 and the sustaining electrode 3 so that a sustaining discharge is generated in the discharge space 10 by an electric field generated between the surface of the protection layer 6 on the dielectric layer 5 over the scanning electrode 2 and the surface of the protection layer 6 on the dielectric layer 5 over the sustaining electrode 3, to thereby produce an image with visible light generated by the sustaining discharge. To provide color display, the phosphor 12 is excited by ultraviolet rays emitted by the sustaining discharge and an image is produced by using visible light emitted by the phosphor 12.

In any case, the panel is configured to allow the image to be viewed from the front substrate side of the panel.

A method for forming the scanning electrode 2, the sustaining electrode 3, the dielectric layer 5 and the protection layer 6 on the first insulating substrate 1 will be described below taking reference to FIG. 2, which is a top view of an edge of the front substrate of FIG. 1, and FIG. 3, which shows a cross sectional view taken along the projected line in FIG. 2.

First, the stripe-shaped transparent electrodes 2*a*, 3*a* made of $SnO_2$ or ITO are formed on the transparent first insulating substrate 1 which, with the black-colored first conductive layers 2*c*, 3*c* made of ruthenium oxide or a compound oxide of ruthenium in stripes having a smaller width, than those of the transparent electrodes 2*a*, 3*a* printed thereon, is dried and fired. At this time, edges of the transparent electrodes 2*a*, 3*a* and the edges of the black-colored first conductive layers 2*c*, 3*c* are formed so as not to reach the edge of the first insulating substrate 1.

The black-colored first conductive layers 2*c*, 3*c* may be made of a material other than ruthenium oxide or a compound oxide of ruthenium. For example, the black-colored first conductive layers 2*c*, 3*c* can be made of a mixture of an inorganic pigment such as iron, nickel, cobalt which have been commonly used for blackening, and silver which is capable of blackening the conductive layer. However, the glass used for the transparent first insulating substrate 1 is usually made in a production process referred to as a floating process, which causes tin atoms to be diffused into the glass. When the glass with silver placed thereon is fired at a high temperature, for example 550° C., silver is diffused to the surface of the glass and reacts to the tin atoms, thereby causing a yellowish discoloration in the glass surface near the silver.

While the AC type plasma display panel has the transparent electrode disposed between the glass and the black first conductive layer, silver atoms in the first conductive layer penetrate the transparent electrode and reach the glass surface thereby reacting to the tin atoms.

Although degree of blackening can be increased by increasing the proportion of the inorganic pigment to silver, the conductivity is decreased. Thus, a certain level of silver content is required to make the layer conductive, and therefore, it is difficult to completely blacken the layer by mixing the inorganic pigment.

Although a black material having an inorganic pigment is capable of substantially complete blackening when the glass surface is polished or protected by a tin free glass material or the like, this increases the amount of labor required and hence, the production cost, and is not practically feasible.

Therefore, the black-colored first conductive layer is made of ruthenium oxide or a compound oxide of ruthenium which does not cause yellowish discoloration even when diffused into the glass, and is capable of almost complete blackening even when float glass, which can be produced at a lower cost, is used.

Then the stripe-shaped second conductive layers 2*d*, 3*d* having widths smaller than that of the black-colored first conductive layers 2*c*, 3*c* are printed on the black-colored first conductive layers, 2*c*, 3*c* and are fired after drying. The silver content of the second conductive layers 2*d*, 3*d* is made 95% or higher in order to have a low resistivity so that a voltage drop does not occur when pulse voltage is applied between the scanning electrode 2 and the sustaining electrode 3.

Operation and effect of the present invention will be described below with reference to FIG. 4 which shows a cross sectional view taken along the projected lines of FIG. 1.

Figure 4:
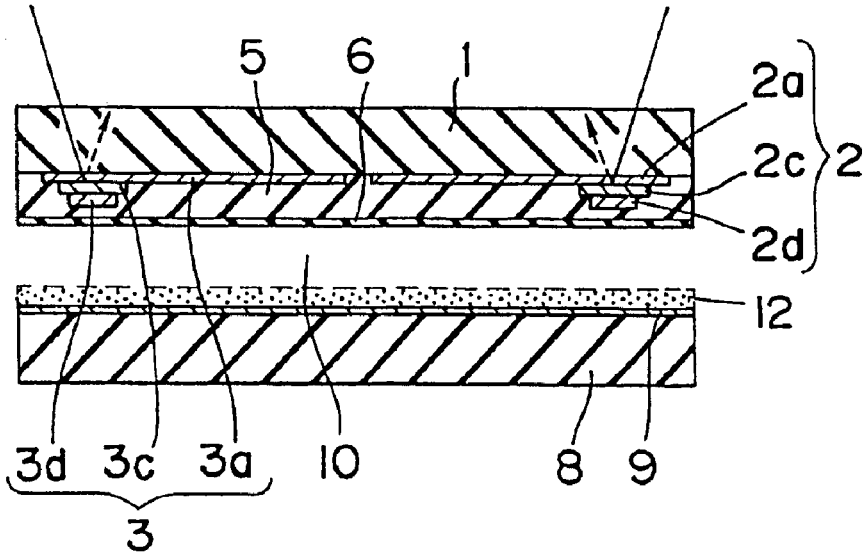
FIG. 4 is a cross-sectional view taken along the projected line of FIG. 1.

By forming the black-colored first conductive layer between the transparent electrodes 2*a*, 3*a* and the second conductive layers 2*d*, 3*d* which are used to apply the voltage to the scanning electrode 2 and the sustaining electrode 3, extraneous light incident thereon as indicated by the solid line in FIG. 4 is absorbed to leave a very weak reflection as indicated by the dashed arrow in the drawing, thus improving the display contrast.

Figure 5:
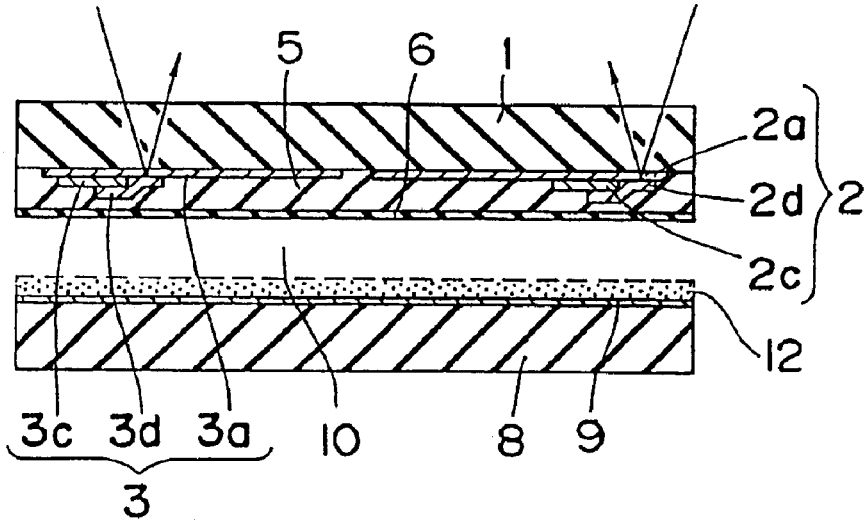
FIG. 5 is a cross-sectional view for explaining the relationship between misalignment of the second conductive layer and extraneous light.

The reason for making the stripe-shaped second conductive layers 2*d*, 3*d* with a smaller width than those of the black-colored first conductive layers 2*c*, 3*c* is as follows. In a case where the first and second conductive layers are formed with the same width, a misalignment caused by a problem in the processing accuracy, thus causes a strip of the second conductive layer to be formed off of an underlying strip of the first conductive layer when forming the second conductive layer on the black-colored first conductive layer as shown in FIG. 5. The misalignment will cause the strip of the second conductive layer, which includes silver, to be formed on the transparent electrodes 2*a*, 3*a* where it should not be formed, resulting in the portion of the second conductive layer containing silver which lies on the transparent electrode to reflect extraneous light, thereby deteriorating the display contrast.

Also, because the second conductive layer contains silver as described above, the glass of the first insulating substrate 1 is discolored to become yellowish in the misplaced portion of the second conductive layer. This makes a region of the transparent electrode near the misplaced portion of the second conductive layer clouded, thus causing poor contrast.

A problem is that processing accuracy is difficult to improve for a large screen such as a 42-inch display. By making the stripe-shaped second conductive layers 2*d*, 3*d* with smaller widths than those of the black-colored first conductive layers 2*c*, 3*c*, so that misalignment due to the processing accuracy has no significant effect, the problem described above can be solved, thus resulting in a stable process where improvement of display contrast by blackening is not compromised and improved production yield is possible.

In a case where a photoresist pattern is formed after forming a film for the first conductive layer and a film for the second conductive layer, and then the first conductive layer and the second conductive layer are formed by etching, there is no possibility of misalignment between the first conductive layer and the second conductive layer, and therefore the first conductive layer and the second conductive layer may be made with the same width.

Figure 2:
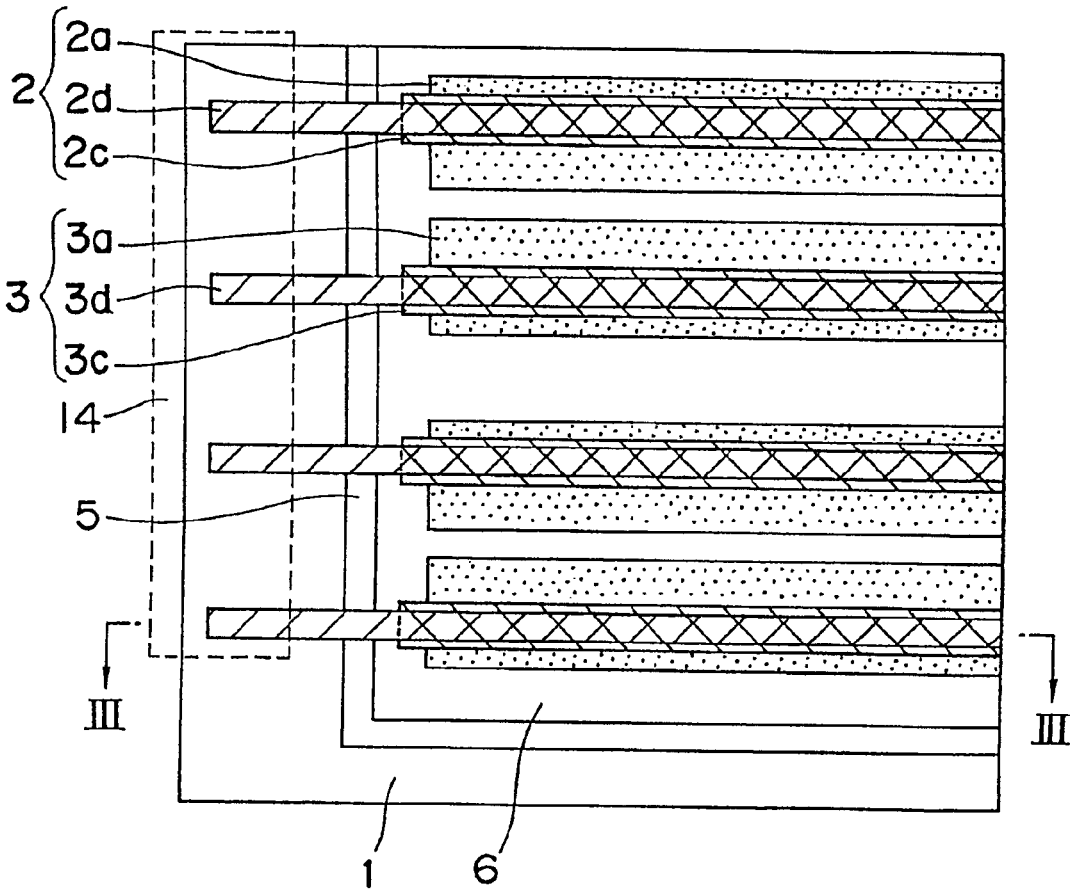
FIG. 2 is a top view of the front substrate of FIG. 1 at an edge thereof.
Figure 3:
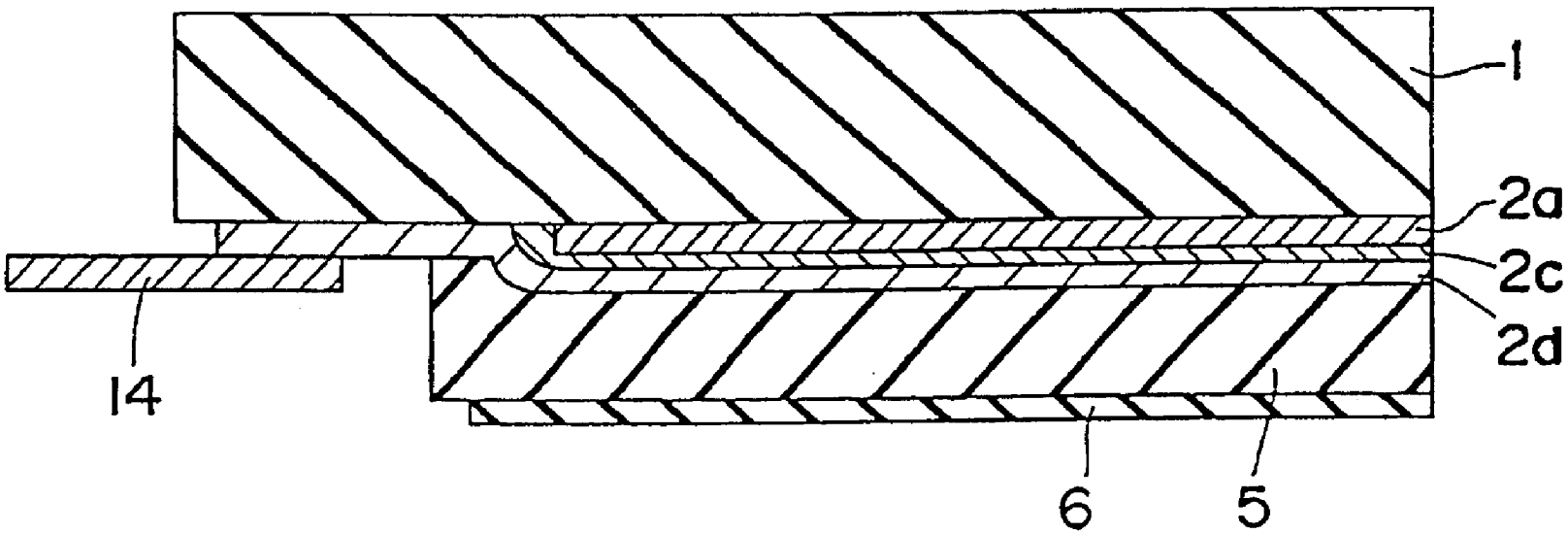
FIG. 3 is a cross-sectional view of an edge of the front substrate taken along a projected line of FIG. 2.

The edges of the stripe-shaped second conductive layers 2*d*, 3*d* are formed to extend to the edge of the first insulating substrate 1 for connection to external circuits as shown in FIG. 2 and FIG. 3. While the black-colored first conductive layers 2*c*, 3*c* can be extended to the edge of the first insulating substrate 1, the first conductive layers are not extended to the edge of the first insulating substrate 1 because ruthenium oxide or a compound oxide of ruthenium that makes up the first conductive layer has a lower bonding strength with the glass that makes up the first insulating substrate 1 than that of the second conductive layers 2*d*, 3*d* made up of a mixture of silver and frit glass.

The portion covered by the dielectric layer 4 is not subject to extraneous mechanical force when incorporated in a panel as shown in FIG. 3 therefore does not require much bonding strength with the glass that makes up the first insulating substrate 1. However, the edges of the glass, where a flexible printed circuit board (FPC) 14 is connected by thermocompression bonding of solder or anisotropic conductive film (ACF) for connection with the external circuits, are required to have a higher bonding strength. Usually, the thermocompression bonding operation causes thermal shock of a duration from 2 to 5 seconds at 200° C. to 250° C. and the external circuit also applies pulse voltage after bonding, and therefore, high reliability is required.

The material made by mixing silver and frit glass can have a high bonding strength when the mixing proportions are adjusted properly. By extending only the stripe-shaped second conductive layers 2*d*, 3*d* made of such a material to the edge of the glass, stable connection with the external circuit can be made with high reliability and without compromising the effect of blackening the effective display area.

Embodiment 2

Figure 6:
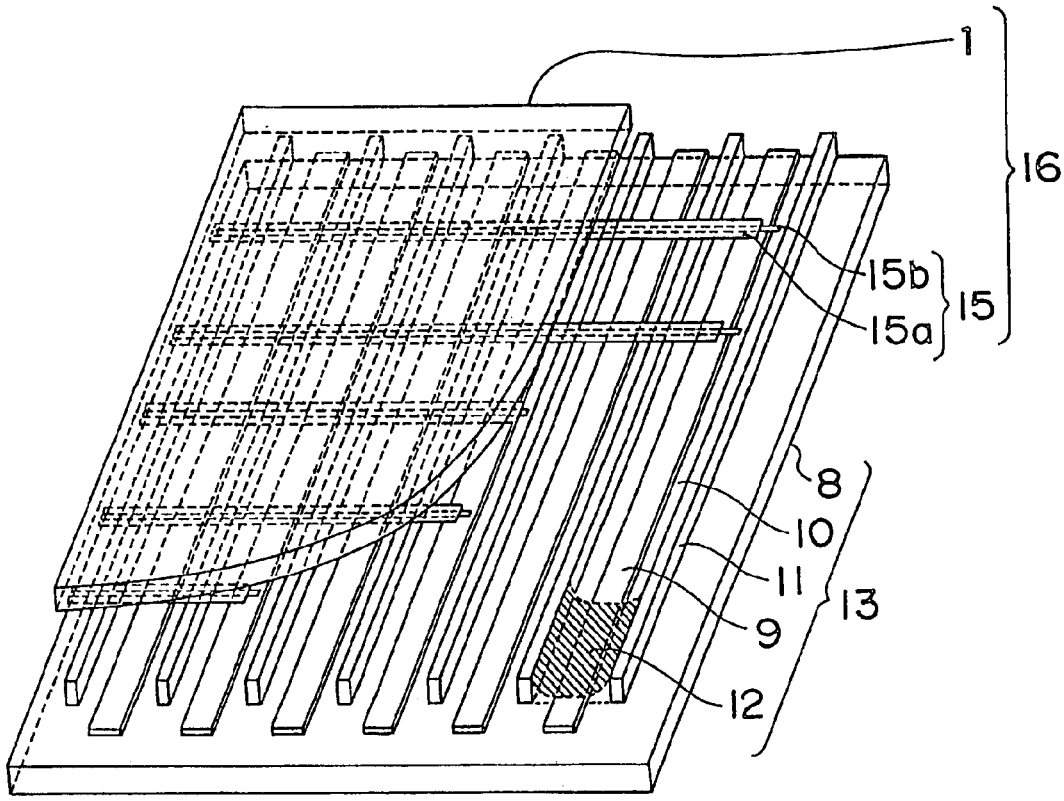
FIG. 6 is a partially cutaway perspective view of the DC type plasma display panel according to the second embodiment of the present invention.
Figure 7:
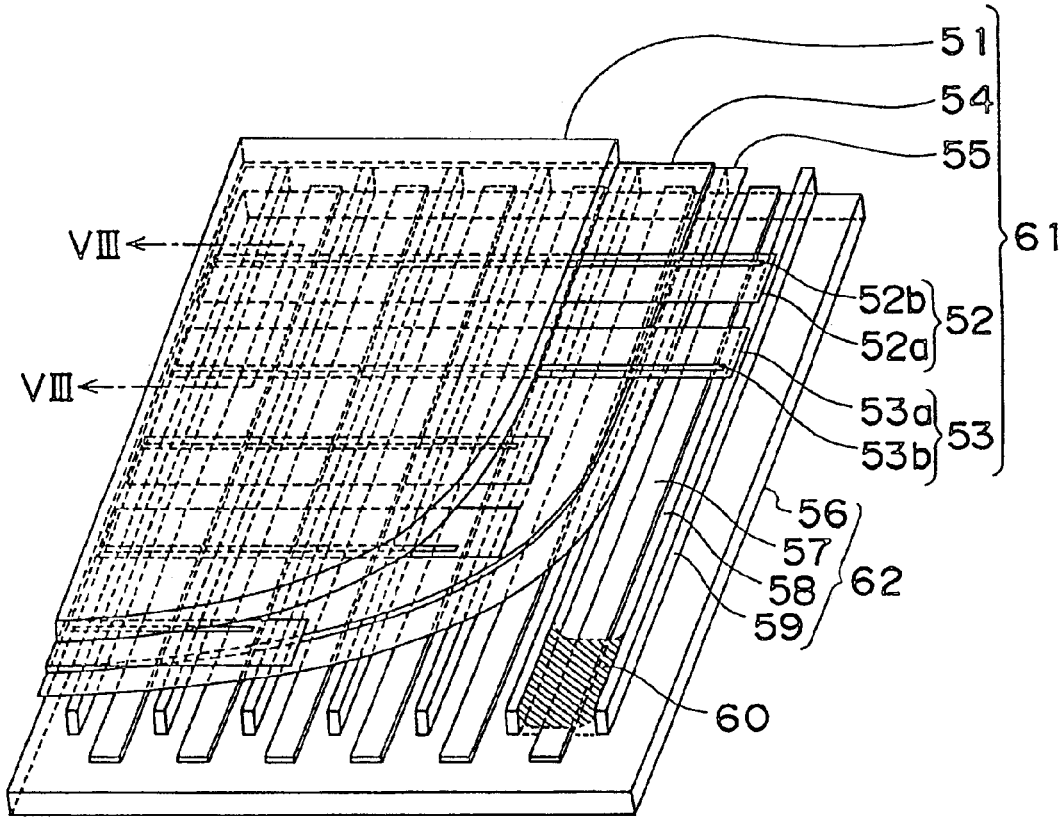
Fig. 7 PRIOR ART
FIG. 7 is a partially cutaway perspective view of the AC type plasma display panel of the prior art.
Figure 8:
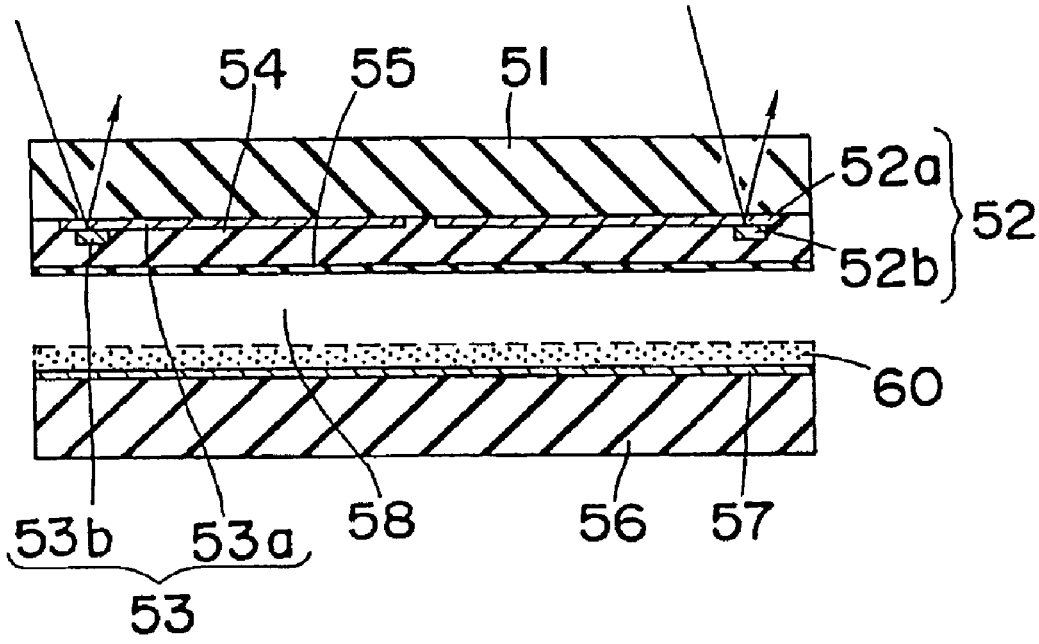
Fig. 8 PRIOR ART
FIG. 8 is a cross-sectional view taken along the projected line of FIG. 7.

FIG. 6 is a partially cutaway perspective view of a DC type plasma display panel according to the second embodiment of the present invention.

The plasma display panel has a configuration with a front substrate 16, including a first insulating substrate 1, and a plurality of first electrodes 15 disposed in parallel to each other as cathodes, and a rear substrate 13, including a plurality of stripe-shaped second electrodes 9 as anodes extending generally perpendicular to the plurality of first electrodes 15, and the stripe-shaped ribs 11 formed between the second electrodes 9 in parallel to each other and forming the discharge space 10, are formed one upon another. The first electrode 15 includes a discharge electrode constituted from a stripe-shaped black-colored -first conductive layer 15*a* and a second conductive layer 15*b* that is formed on the former and has a lower resistivity than the former.

The second conductive layer 15*b* is made with a width smaller than those of the first conductive layer 15*a*, and extends to the edge of the transparent first insulating substrate 1.

The black-colored first conductive layer 15*a* is formed from ruthenium oxide or a compound oxide of ruthenium, while the second conductive layer 15*b* is formed from a conductive film including silver. The discharge space 10 is filled with a discharge gas including at least one kind of rare gas chosen from helium, neon, argon, krypton and xenon.

When the panel is used for color display, a phosphor 12 (only a part of which is shown) is formed to extend over the second electrode 9 to the side face of the ribs 11.

Now the operation of the DC type plasma display panel will be described below.

In a sustaining period of a drive operation, a pulse voltage is applied between the first electrode 15 which serves as the cathode and the second electrode 9 which serves as the anode so that a sustaining discharge is generated in the discharge space 10 to thereby produce an image with visible light generated by the sustaining discharge. To provide a color display, the phosphor 12 is excited by ultraviolet rays emitted by the sustaining discharge and an image is produced by using visible light emitted by the phosphor 12.

In either case, the panel is configured to allow the displayed image to be viewed from the front substrate side of the panel.

Also, in the case of the DC type plasma display panel, the discharge electrode includes the black-colored first conductive layer 15*a* and the second conductive layer 15*b*. The second conductive layer 15*b* is formed on the first conductive layer 15*a*, has a width smaller than that of the first conductive layer, has a lower resistivity than the first conductive layer, and extends to the edge of the first insulating substrate. Therefore, the operation and effect of this embodiment are the same as those of the first embodiment, and the description thereof will be omitted.

Figure 9:
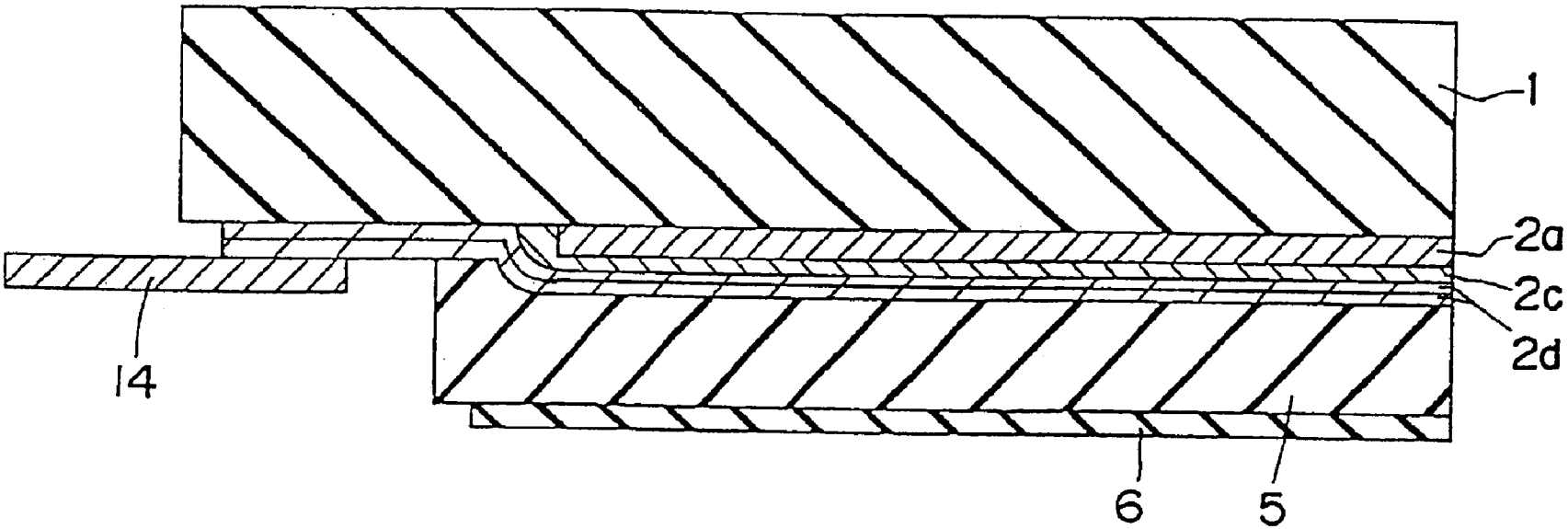
FIG. 9 is a cross-sectional view of an edge of the front substrate schematically showing the second conductive layer including a plurality of layers.

Although the second conductive layer of the first and second embodiments includes a single conductive layer which contains silver, the second conductive layer may also include a plurality of layers as schematically illustrated in FIG. 9. When the second conductive layer includes a plurality of layers, a low-resistance film may be provided to improve the conductivity. Further, a film which shuts off the transfer of silver may be formed between the second conductive layer that contains silver and the first conductive layer, thereby preventing the glass substrate from clouding.

The plasma display panel according to the present invention, having the black-colored first conductive layer formed between the transparent insulating substrate and the second conductive layer formed thereon for applying voltage, is capable of reducing the reflection of extraneous light, improving the display contrast and improving the panel characteristics.

What is claimed is:

1. A method of forming a plurality of stripe-shaped first electrodes of a plasma display panel comprising a front substrate comprising a transparent first insulating substrate made of float glass and the plurality of stripe-shaped first electrodes extending parallel to each other, and a rear substrate comprising a second insulating substrate, a plurality of second electrodes extending parallel to each other and being formed on the second insulating substrate, and a plurality of ribs formed on the second insulating substrate separating adjacent second electrodes of the plurality of second electrodes and forming a plurality of discharge spaces therebetween, wherein the front substrate and the rear substrate are formed upon each other and the plurality of stripe-shaped first electrodes extend generally perpendicular to the plurality of second electrodes, said method of forming the plurality of stripe-shaped first electrodes comprising:

forming a plurality of stripe-shaped transparent electrodes on the transparent first insulating substrate;

applying a first conductive paste layer containing ruthenium oxide or a compound made of ruthenium on the plurality of stripe-shaped transparent electrodes;

firing the first conductive paste layer thereby forming a black-colored first conductive layer;

applying a second conductive paste layer containing silver on the black-colored first conductive layer so that the second conductive paste layer has a width smaller than that of the black-colored first conductive layer; and firing the second conductive paste layer thereby forming a second conductive layer having a lower resistivity than the black-colored first conductive layer and also having a width smaller than that of the black-colored first conductive layer.

2. The method according to claim 1, wherein the second conductive paste layer is formed so as to extend to a terminal portion of the transparent first insulating substrate to be connected with an external electrode.

* * * * *